US009477206B2

(12) United States Patent
Philippine

(10) Patent No.: US 9,477,206 B2
(45) Date of Patent: Oct. 25, 2016

(54) SPLIT-SECONDS DEVICE WITH EPICYCLOIDAL TRAIN FOR A TIMEPIECE

(71) Applicant: Société anonyme de la Manufacture d'horlogerie Audemars Piguet & Cie, Le Brassus (CH)

(72) Inventor: Thibaut Philippine, Vallorbe (CH)

(73) Assignee: SOCIÉTÉ ANONYME DE LA MANUFACTURE D'HORLOGERIE AUDEMARS PIGUET & CIE, Le Brassus (CH)

( * ) Notice: Subject to any disclaimer, the term of this patent is extended or adjusted under 35 U.S.C. 154(b) by 0 days.

(21) Appl. No.: 14/934,003

(22) Filed: Nov. 5, 2015

(65) Prior Publication Data

US 2016/0139567 A1 May 19, 2016

(30) Foreign Application Priority Data

Nov. 13, 2014 (CH) ..... 1760/14

(51) Int. Cl.
*G04F 7/08* (2006.01)
*G04B 13/00* (2006.01)

(52) U.S. Cl.
CPC ..... *G04F 7/0871* (2013.01); *G04B 13/008* (2013.01); *G04F 7/0842* (2013.01); *G04F 7/0876* (2013.01)

(58) Field of Classification Search
CPC .. G04F 7/0876; G04F 7/0842; G04F 7/0871; G04F 7/08; G04B 13/008
See application file for complete search history.

(56) References Cited

U.S. PATENT DOCUMENTS 6,685,352 B1 2/2004 Capt et al.
7,014,356 B2 * 3/2006 Bobe ..... G04F 7/08 368/102

(Continued)

FOREIGN PATENT DOCUMENTS

CH 3914/101 8/1891
CH 6180 1/1893

(Continued)

OTHER PUBLICATIONS

Description translation for CH704120—epo.org—Jul. 20, 2016.*

(Continued)

*Primary Examiner* — Sean Kayes
(74) *Attorney, Agent, or Firm* — Christensen Fonder P.A.

(57) ABSTRACT

A split-seconds device with epicycloidal train for a timepiece. The device includes a split-seconds pinion which carries a fly-back hand and is mounted to rotate freely about a rotation arbor of the timepiece; a differential having an entry wheel adapted to be kinematically connected to a power source of the timepiece; a first exit wheel kinematically connected to the entry wheel by a planetary wheel and meshing with the split-seconds pinion; a second exit wheel kinematically connected to the entry wheel by the planetary wheel; and a control lever allowing to block either the first exit wheel or the second exit wheel, such that whichever of the first and second exit wheels is released by the control lever is adapted to be driven by the entry wheel when the latter is kinematically connected to the power source of the timepiece, thus allowing to block or respectively release the fly-back hand.

13 Claims, 7 Drawing Sheets

(56) References Cited

U.S. PATENT DOCUMENTS

| | | | | |
|---|---|---|---|---|
| 7,293,911 | B2 * | 11/2007 | Bonvin | G04F 3/022 368/106 |
| 7,480,211 | B2 | 1/2009 | Golay | |
| 8,737,176 | B2 * | 5/2014 | Bas | G04B 5/02 368/220 |
| 8,848,488 | B2 * | 9/2014 | Calabrese | G04B 19/235 368/101 |
| 2005/0249043 | A1 | 11/2005 | Bobe et al. | |
| 2007/0091727 | A1 | 4/2007 | Bonvin et al. | |
| 2007/0091728 | A1 * | 4/2007 | Girardin | G04B 1/12 368/142 |
| 2008/0205200 | A1 | 8/2008 | Spode et al. | |
| 2009/0129209 | A1 | 5/2009 | Golay | |
| 2012/0020192 | A1 | 1/2012 | Calabrese | |
| 2012/0269044 | A1 | 10/2012 | Bas et al. | |
| 2013/0100781 | A1 * | 4/2013 | Richard | G04F 7/0828 368/106 |
| 2014/0355394 | A1 * | 12/2014 | Graemiger | G04F 7/0871 368/80 |

FOREIGN PATENT DOCUMENTS

| | | | |
|---|---|---|---|
| CH | 7411 | | 10/1893 |
| CH | 10027 | | 4/1895 |
| CH | 11853 | | 1/1896 |
| CH | 27052 | | 11/1902 |
| CH | 165556 | | 11/1933 |
| CH | 216001 | | 7/1941 |
| CH | 260791 | | 3/1949 |
| CH | 278478 | | 10/1951 |
| CH | 693 155 | A5 | 3/2003 |
| CH | 698 906 | A2 | 11/2009 |
| CH | 702 808 | A2 | 9/2011 |
| CH | 702992 | A1 | 10/2011 |
| CH | 703008 | A1 | 10/2011 |
| CH | 704 120 | A2 | 5/2012 |
| DE | 102004017345 | B3 | 9/2005 |
| DE | 10 2006 008 700 | B3 | 8/2007 |
| EP | 0 921 451 | A1 | 6/1999 |
| EP | 1 372 117 | B1 | 4/2008 |
| EP | 1074897 | B1 | 4/2009 |
| EP | 2063326 | A2 | 5/2009 |
| EP | 2 112 564 | A1 | 10/2009 |
| EP | 2 133 760 | A3 | 12/2009 |
| EP | 2080069 | B1 | 2/2010 |
| EP | 1959317 | B1 | 4/2010 |
| EP | 1818738 | A3 | 5/2011 |
| EP | 2410388 | A1 | 1/2012 |
| EP | 1777598 | B1 | 2/2012 |
| FR | 1 164 020 | | 10/1958 |
| GB | 388258 | | 2/1933 |
| JP | 2009-19987 | A | 1/2009 |
| WO | WO 2011/131788 | A1 | 10/2011 |

OTHER PUBLICATIONS

Description translation for EP1372117—epo.org—Jul. 20, 2016.*

* cited by examiner

SPLIT-SECONDS DEVICE WITH EPICYCLOIDAL TRAIN FOR A TIMEPIECE

RELATED APPLICATION

The present application claims priority to Swiss Patent Application No. 01760/14, filed Nov. 13, 2014, the disclosure of which is hereby incorporated by reference herein in its entirety.

FIELD OF THE INVENTION

The present invention relates to a split-seconds device for a timepiece, in particular for a chronograph watch, the device having a split-seconds pinion which carries a fly-back hand and is mounted such as to rotate freely about a rotation arbor of said timepiece.

In general, the invention relates to timepieces having a mechanical movement, in particular mechanical wristwatches. This type of timepiece is sometimes equipped with a function referred to as a split-seconds function. In this case one or more hands of the watch has/have a fly-back hand superposed in the normal working state of the watch on a corresponding hand. By actuating a split-seconds push-piece, the user can stop the fly-back hand, whilst the corresponding hand continues to turn, then, by actuating said split-seconds push-piece again, the user can make the fly-back hand return to the position superposed with the corresponding hand. This function is normally deployed in the case of chronograph watches by equipping at least one or all of the chronograph hands with a fly-back hand, thus allowing the timing of intermediate periods without stopping the timing of the main measured time, for example.

BACKGROUND

In this context numerous mechanisms making it possible to provide this function are known. The majority of these mechanisms work on the basis of split-seconds pliers, which can be controlled by a column-wheel and allow to block or release the split-seconds pinion carrying the fly-back hand. This, however, entails a number of disadvantages, inter alia due to the fact that the working accuracy or the timing of the corresponding timepiece may vary depending on the working state of the fly-back hand. In fact, the energy required by the power source of the timepiece in order to drive the hands varies depending on the state of said split-seconds pliers, given that split-seconds pliers closed such as to stop the fly-back hand causes friction between the split-seconds lever and the split-seconds heart, which in conventional split-seconds mechanisms allow to return the fly-back hand into superposition with the corresponding hand. In order to overcome this problem, it is known in very high-class watch models to provide a lifting-lever mechanism allowing to lift the split-seconds lever when the split-seconds pliers are closed such as to isolate said lever from the split-seconds heart, however this is a complex and costly solution. In addition, this type of split-seconds mechanism necessitates to equip very thin arbors, such as the arbors carrying the chronograph hands, with hearts against which corresponding hammers tap repeatedly when the fly-back hand is to be re-synchronized with the corresponding hand. In the long term this increases the risk of damage to the mechanism. In addition, a split-seconds mechanism of this type considerably increases the complexity of the timepiece whilst adding, for example, in the case of application to a chronograph watch, solely the measurement of intermediate times without interruption of the main timing as an additional function.

SUMMARY OF THE INVENTION

It should thus be noted that, in spite of the fact that a number of prior art solutions exist for producing a split-seconds mechanism, these solutions are not entirely satisfactory, in particular with regard to the negative effects of such a mechanism on the working accuracy of the timepiece equipped therewith, the complexity involved in attempting to overcome this problem, and also the additional contribution offered by such a mechanism.

An object of the present invention is therefore to overcome, at least in part, the disadvantages of the known devices and to produce a split-seconds device for timepieces that has a simple and robust structure, inter alia in order to ensure a reasonable production cost, as well as a reliable operation, and that limits the negative effects of such a mechanism on the working accuracy of the corresponding timepiece. In addition, the device should optionally lend itself to supplement the functions offered by such a split-seconds mechanism, in particular in the case of integration thereof in a chronograph watch.

To this end, the present invention proposes a split-seconds device of the above-mentioned type, which distinguishes itself by the features mentioned in the claims. In particular, the device according to an embodiment comprises a differential having an entry wheel adapted to be kinematically connected to a power source of the timepiece, a first exit wheel kinematically connected to the entry wheel by at least one planetary wheel and meshing with the split-seconds pinion, a second exit wheel kinematically connected to said entry wheel by said at least one planetary wheel, and a control lever allowing to block either the first exit wheel or the second exit wheel, such that whichever of the first exit wheel and the second exit wheel is released by the control lever is adapted to be driven by said entry wheel when the latter is kinematically connected to the power source of the timepiece, thus allowing to block or respectively to release said fly-back hand.

As a result of these measures the device allows to drive or to block a fly-back hand, for example, of a chronograph of a mechanical watch, with the aid of a planetary system placed between the power source of the timepiece and the pinion of the fly-back hand. The use of a differential makes it possible to reduce simultaneously, and in a relatively simple manner, the difference of the working accuracy of conventional split-seconds mechanisms between their working state and their stopped state, limiting the negative effects of the presence of a fly-back hand on the working accuracy of the timepiece equipped with this device.

The device may also comprise a difference wheel carrying a difference hand, as well as an intermediate wheel, or respectively an adjacent wheel carrying a heart, the intermediate wheel meshing with said difference wheel and being kinematically connected to the second exit wheel. This makes it possible, on the one hand, to press the necessary hammers in this type of mechanism against arbors other than the thin arbors carrying the hands, and also, on the other hand, to integrate an additional function in a split-seconds mechanism, i.e., the display of the time difference between the fly-back hand and the corresponding hand, for example, the chronograph hand, when the fly-back hand is stopped.

In another embodiment of the device according to the invention the entry wheel of the differential is formed by a sun wheel secured to a sun pinion, the first exit wheel is formed by a planet carrier carrying at least one planetary wheel meshing with said sun pinion, and the second exit train is formed by an outer toothing of a crown meshing by means of an inner toothing with said at least one planetary wheel.

In addition, embodiments also relate to a chronograph mechanism having such a split-seconds device with epicycloidal train. In general, the latter is suitable for use in a number of horological applications, such that it can be used in chronograph watches, but also in other types of timepieces.

Further features as well as the corresponding advantages will become clear from the claims and also from the description describing the invention hereinafter in greater detail.

BRIEF DESCRIPTION OF THE DRAWINGS

The accompanying drawings schematically show an embodiment of the invention by way of example.

DETAILED DESCRIPTION OF THE INVENTION

Embodiments of the invention will now be described in detail with reference to the accompanying drawings illustrating embodiments of the invention by way of example.

Embodiments of the invention relate to a split-seconds device with epicycloidal train intended to be integrated in a timepiece, preferably in a wristwatch having a mechanical movement, and more particularly in a chronograph watch. For reasons of simplification of the language used, reference will be made hereinafter indifferently to "timepiece" and "watch", without limiting the scope of the corresponding explanations, which in all cases extend to any type of timepieces, having either a mechanical or electrical power source. In addition, such a split-seconds device with epicycloidal train can be integrated in modules of such a timepiece, such as a chronograph mechanism, or other mechanisms able to be equipped with a split-seconds device with epicycloidal train according to embodiments. If the split-seconds device with epicycloidal train according to the present invention is described hereinafter by way of example in the context of a chronograph mechanism, this does not limit the scope of protection for this invention, because an integration in other timepiece types is possible by analogy. Due to the fact that a chronograph mechanism, or other similar mechanisms suitable for combination with the split-seconds device with epicycloidal train according to the invention, are known per se to the person skilled in the art, the following description will be limited primarily and in so far as possible to the structure and to the operation of said split-seconds device with epicycloidal train.

Figure 1:
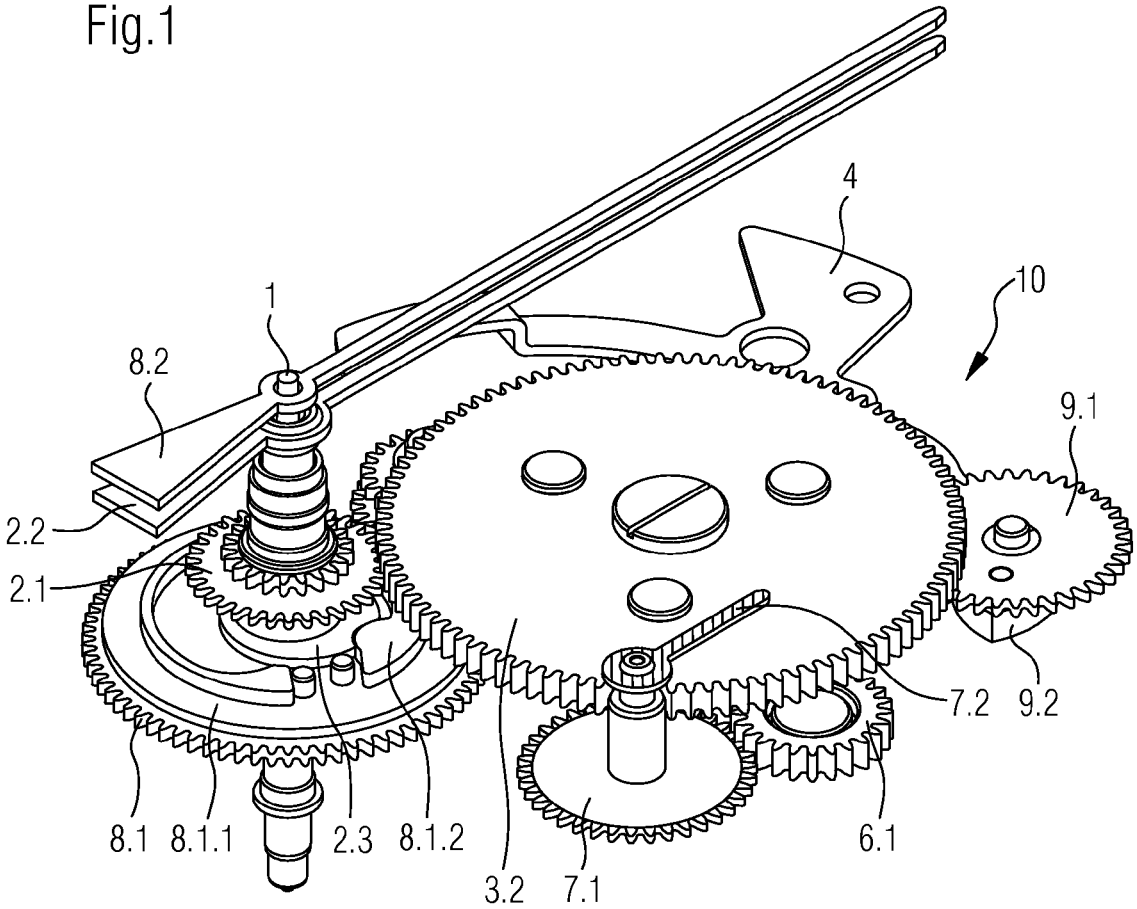
FIG. 1 shows a schematic perspective view from above of a split-seconds device with epicycloidal train according to an embodiment when the device is integrated, by way of example, in a chronograph watch, the parts of the chronograph mechanism being indicated merely by way of example.
Figure 2A:
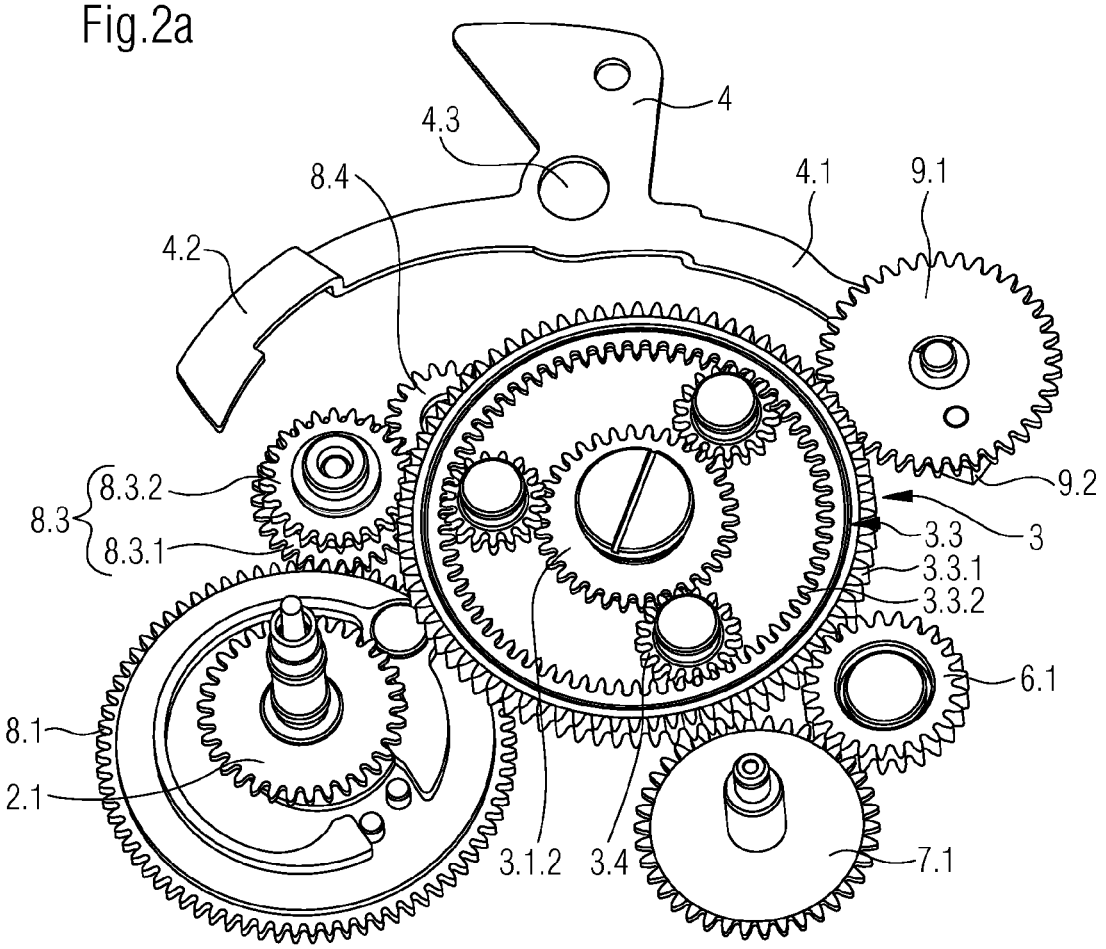
FIG. 2*a* shows a perspective view from above, without the planet carrier, of the differential used in the split-seconds device with epicycloidal train of FIG. 1.
Figure 2B:
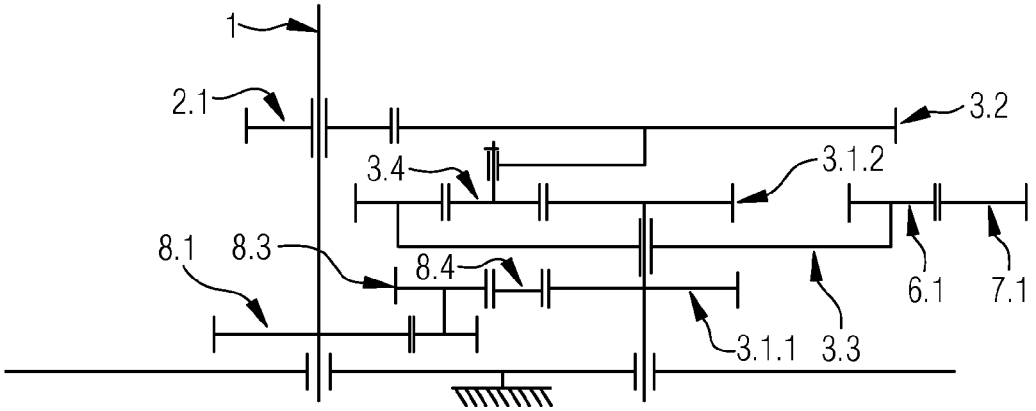
FIG. 2*b* shows a schematic longitudinal section through this device.
Figure 3A:
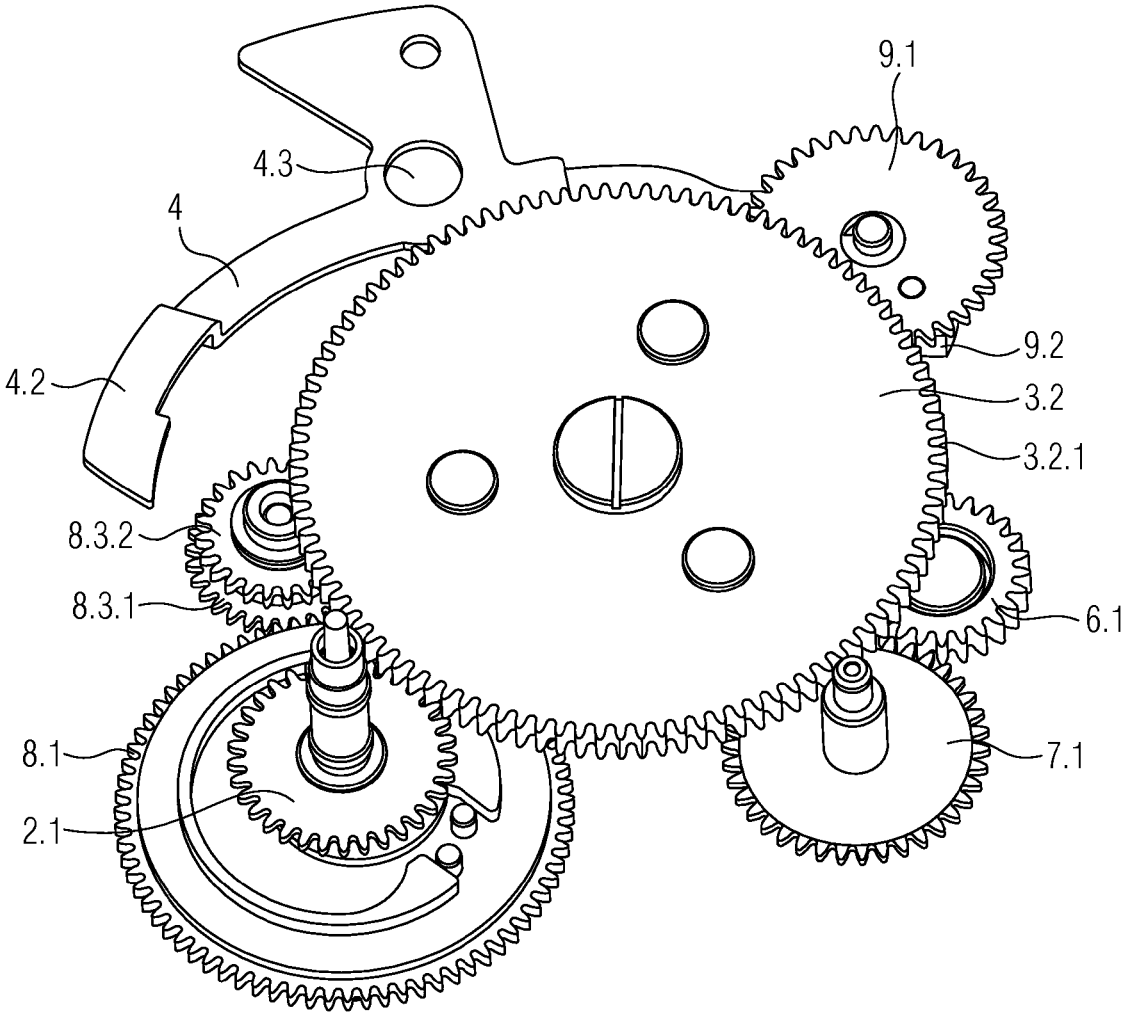
FIG. 3*a* shows a schematic perspective view from above of a split-seconds device with epicycloidal train according to an embodiment when the device is in a first operating position in which the fly-back hand is released.
Figure 3B:
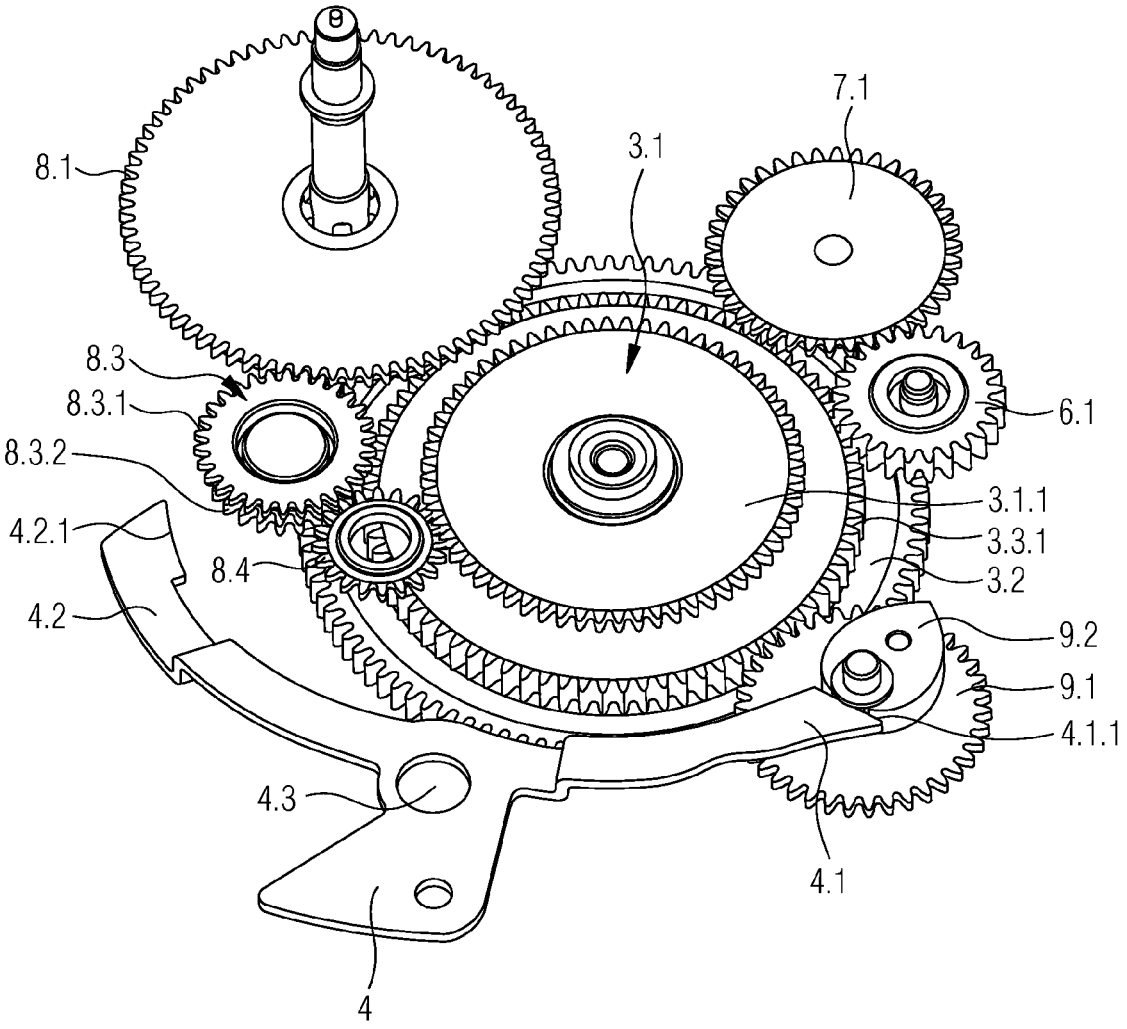
FIG. 3*b* shows a schematic perspective view from below of the device located in the first operating position according to FIG. 3*a*, allowing to see the cooperation between the control lever and the heart on the adjacent wheel.
Figure 3C:
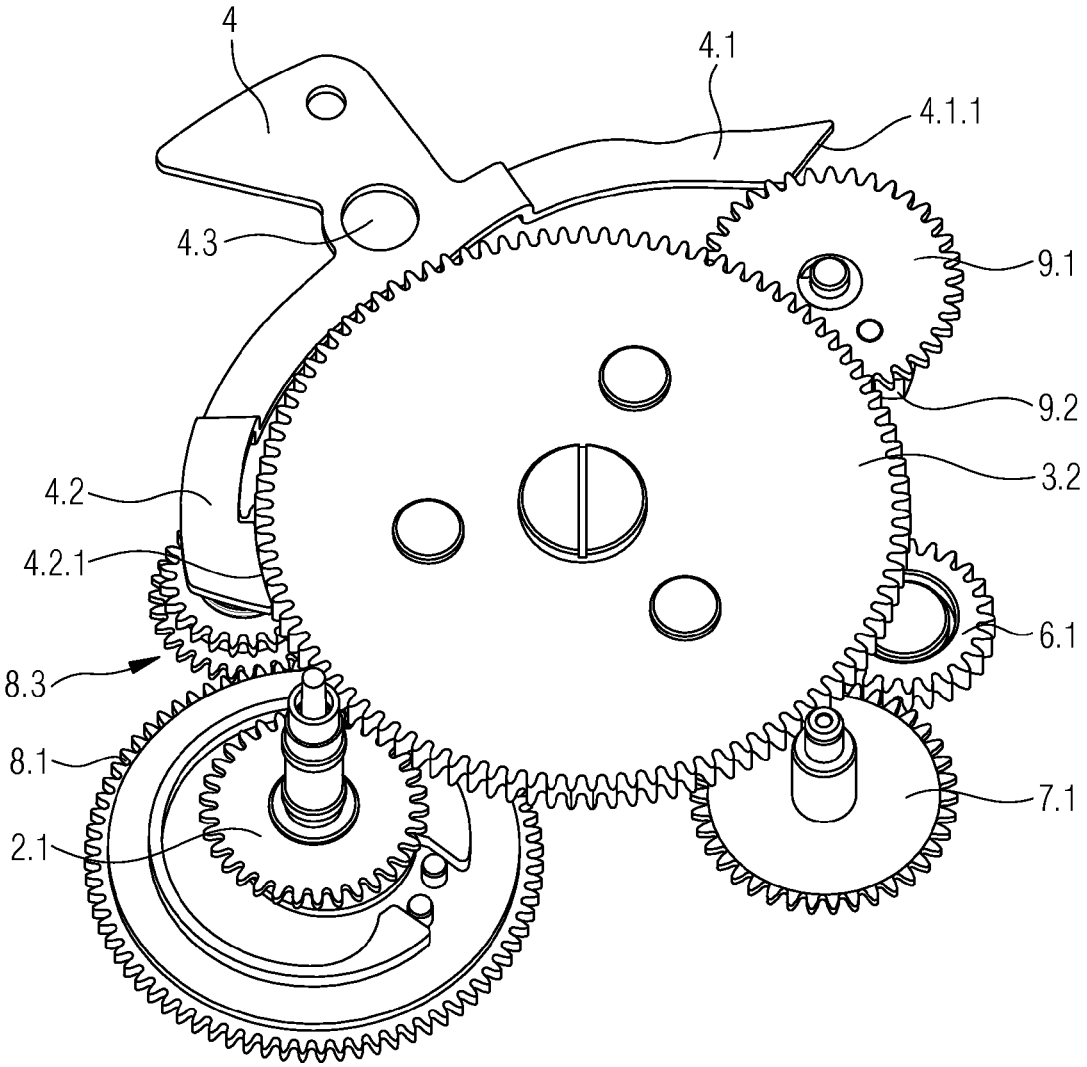
FIG. 3*c* is a schematic perspective view from above of the split-seconds device with epicycloidal train of FIG. 3*a* when the device is in a second operating position in which the fly-back hand is blocked.

In order to comment first on the structure and the components of a split-seconds device with epicycloidal train according to the embodiments, reference is made to FIGS. 1 and 2*a* to 2*b*, which illustrate schematically and by way of example a preferred embodiment of such a device within the scope of the integration thereof in a chronograph mechanism or respectively in a chronograph watch.

As can be seen in FIG. 1, which shows a schematic perspective view from above of a split-seconds device with epicycloidal train according to the present invention, this split-seconds device 10, as is conventional, has a split-seconds pinion 2.1 which carries a fly-back hand 2.2 and which is mounted such as to rotate freely about a rotation arbor 1 of said timepiece. In the illustrated example the device is integrated in a chronograph watch, the parts of the chronograph mechanism being indicated merely symbolically by the chronograph wheel 8.1 carrying a chronograph hand 8.2. In this case the split-seconds pinion 2.1 and the fly-back hand 2.2 are mounted such as to rotate freely about the rotation arbor 1 of the chronograph wheel 8.1 and of the chronograph hand 8.2. The driving train of the chronograph and the other parts of the chronograph mechanism, such as the control thereof, are not illustrated, these parts of the chronograph mechanism being known to the person skilled in the art and not requiring a detailed description here. The person skilled in the art will also know how the chronograph wheel 8.1 can be connected, following a first actuation of a start-stop chronograph push-piece which is not illustrated in the figures, to the geartrain of the timepiece such as to drive the chronograph hand 8.2, then stop it following a second actuation of the start-stop chronograph push-piece by disconnecting the chronograph wheel from said train of the timepiece. An actuation of a zero reset push-piece then makes it possible to reset the chronograph hand to zero.

As illustrated also in FIGS. 2*a* and 2*b*, which show a perspective view from above, without the planet carrier, of the differential used in the split-seconds device with epicycloidal train of FIG. 1 and, respectively a schematic longitudinal section through this device, a split-seconds device with epicycloidal train 10 according to the present invention distinguishes itself from the prior art devices due to the fact that it comprises, in general terms, a differential 3 having an entry wheel 3.1 adapted to be kinematically connected to a power source of the timepiece, a first exit wheel 3.2 kinematically connected to the entry wheel 3.1 by at least one planetary wheel 3.4 and meshing with the split-seconds pinion 2.1, and a second exit wheel 3.3 kinematically connected to said entry wheel 3.1 by said at least one planetary wheel 3.4. The device also has a control lever 4 allowing to block either the first exit wheel 3.2 or the second exit wheel 3.3 such that whichever of the first exit wheel 3.2 and the second exit wheel 3.3 is released by the control lever 4 is adapted to be driven by said entry wheel 3.1 when the latter is kinematically connected to the power source of the timepiece, thus allowing to block or respectively to release said fly-back hand 2.2. The control lever 4 is prestressed by a retaining spring which is not illustrated in the figures in a first position in which the lever 4 blocks the second exit wheel 3.3, such that the fly-back hand 2.2 is normally in the released state. By actuating a split-seconds push-piece which is not shown in the figures and is known to the person skilled in the art, the user of the timepiece integrating a split-seconds device 10 according to the present invention can bring the lever 4 into a second position in which the lever 4 blocks the first exit wheel 3.2, such that the fly-back hand 2.2 is blocked. By actuating the split-seconds push-piece again, the lever 4 releases the first exit wheel 3.2 and returns to its first position in which the lever 4 blocks the second exit wheel 3.3.

The device preferably also comprises a difference wheel 7.1 kinematically connected to the second exit wheel 3.3 and carrying a difference hand 7.2, as well as an intermediate wheel 6.1 kinematically connected to the second exit wheel 3.3, the intermediate wheel 6.1 meshing with said difference wheel 7.1. An adjacent wheel 9.1 is preferably arranged at the periphery of the second exit wheel 3.3 such as to mesh with the latter and carries a heart 9.2. Alternatively said heart could be mounted on the intermediate wheel 6.1 or on the difference wheel 7.1. In fact, the use of an intermediate wheel 6.1 or of a similar train, respectively of an adjacent wheel 9.1 makes it possible to place the difference wheel 7.1, respectively the heart 9.2 in a desired location, respectively on an independent arbor that can be strengthened, but the use of these optional parts is not necessary.

FIGS. 1, 2*a*, 2*b*, and 3*b* show an embodiment of a split-seconds device with epicycloidal train in which the entry wheel 3.1 of the differential 3 is formed by a sun wheel 3.1.1 secured to a sun pinion 3.1.2. The first exit wheel 3.2 is formed in this embodiment by a planet carrier 3.2 mounted such as to rotate freely about the arbor of the differential 3 and carrying at least one planetary wheel 3.4 meshing with said sun pinion 3.1.2. Three planetary wheels 3.4 of which the arbors are arranged at an equal angular distance from one another are preferably arranged on the plate of the planet carrier 3.2. The second exit wheel 3.3 is formed by an outer toothing 3.3.1 of a crown 3.3 mounted such as to rotate freely about the arbor of the differential 3 and meshing by means of an inner toothing 3.3.2 with said at least one planetary wheel 3.4. The outer toothing 3.3.1 of said crown 3.3 forming the second exit wheel 3.3 meshes in this case with said intermediate wheel 6.1, which meshes in turn with the difference wheel 7.1, thus forming the kinematic connection between the difference wheel 7.1 and the second exit wheel 3.3 in a particularly simple manner. As indicated schematically in FIG. 2*b*, the rotation arbor 1 of the chronograph wheel 8.1 and also the arbor of the differential are mounted on, the frame of the timepiece. Likewise, the lever 4 is hinged about a pivot axis 4.3, and said retaining spring exerts a prestress on a first free end 4.1 of the lever 4 such as to hold the lever 4 in a first position in which the first end 4.1 thereof blocks the second exit wheel 3.3. The first end 4.1 and a free second end 4.2 of the lever 4 are each equipped with a resting zone 4.1.1, 4.2.1 adapted to cooperate with said heart 9.2, or respectively with the planet carrier 3.2, and allowing to press, either by means of said resting zone 4.1.1, on the heart 9.2 mounted on the adjacent wheel 9.1, or, by means of said resting zone 4.2.1, on the outer toothing of the planet carrier 3.2.

It is clear to a person skilled in the art that the differential of the split-seconds device 10 according to the present invention may be arranged differently without this having any significant influence on the structure or on the operation of the device. Amongst others, it is possible to exchange not only the structure of the entry wheel 3.1 and of the exit wheels 3.2, 3.3, given that numerous types of differential are known to a person skilled in the art, but also the function of these wheels. For example, the entry wheel 3.1 could act as an exit wheel, and the function of the exit wheels 3.2, 3.3 could clearly be reversed by connecting the first exit wheel 3.2 by means of the intermediate wheel 6.1 to the difference wheel 7.1 and the second exit wheel 3.3 to the split-seconds pinion 2.1. Likewise, the control lever 4 could be replaced by another equivalent control means adapted to cooperate in a similar manner with the split-seconds push-piece. In a variant it is also possible to arrange the heart 9.2 on the difference wheel 7.1 or on the split-seconds pinion 2.1, but these constellations are less preferred because the lever 4 acts as a hammer acting repeatedly on the heart 9.2. The preferred embodiment makes it possible to avoid placing the heart 9.2 on a thin arbor such as that of the fly-back hand.

Further modifications are possible with regard to the trains providing the different kinematic connections mentioned above. Amongst others, the kinematic connection between the chronograph wheel 8.1 and the entry wheel 3.1 of the differential 3 is provided, in the embodiments illustrated in the figures, by means of a first intermediate pinion 8.3 having a first toothing 8.3.1 meshing with the chronograph wheel 8.1 and a second toothing 8.3.2 meshing with a second intermediate pinion 8.4, the latter meshing with the entry wheel 3.1. Although this solution makes it possible to choose the gear ratio between the chronograph wheel 8.1 and the entry wheel 3.1 in a particularly simple manner, it is also possible that the chronograph wheel 8.1 meshes directly with the entry wheel 3. Similarly, it is possible to provide an intermediate train instead of the planet carrier 3.2 meshing directly with the split-seconds pinion 2.1, and for example, to use this intermediate train to place the heart 9.2, depending on the use of parts of the differential 3 as entry or exit respectively.

Figure 4:
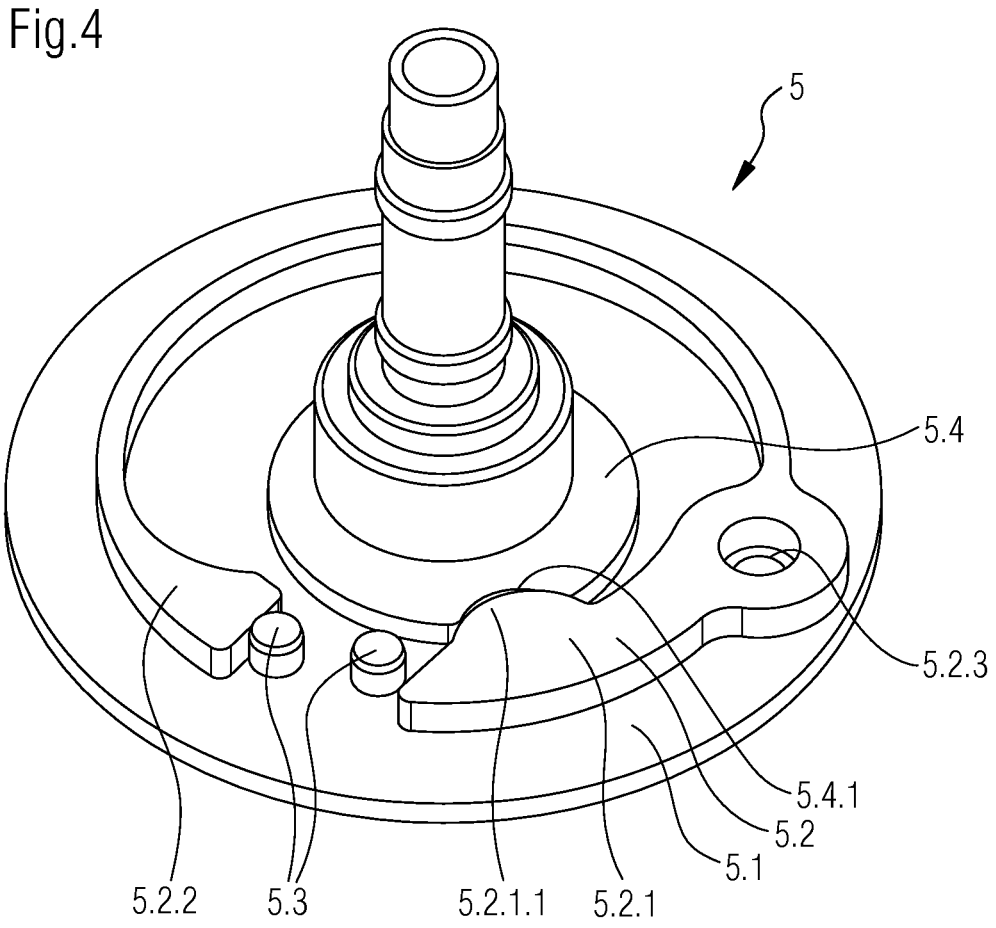
FIG. 4 shows, in a schematic view from above, a play-cancelling means disposed between the chronograph wheel and the split-seconds wheel of a split-seconds device with epicycloidal train according to the present invention.

In addition, a split-seconds device with epicycloidal train according to an embodiment may be equipped with a play-cancelling mechanism or means 5 disposed between the chronograph wheel and the split-seconds wheel, as illustrated in FIG. 4 by a schematic view from above. This play-cancelling means comprises a support 5.1 in the form of a disc secured to the chronograph wheel 8.1, and therefore to the chronograph hand 8.2, and carrying a jumper 5.2 of substantially circular shape, of which the angular position about an arbor 5.2.3 can be adjusted. The jumper 5.2 almost forms a complete circle, pins 5.3 being placed in the angular sector not occupied by said jumper. A first free end 5.2.1 of the jumper 5.2 forms a short arm equipped with a rounded addendum 5.2.1.1, whilst a second free end 5.2.2 of the jumper 5.2 forms a long arm forming an extended arc of a circle. The play-cancelling means 5 also comprises an eccentric 5.4 of substantially elliptical shape secured to the split-seconds wheel 2.1, and therefore to the fly-back hand 2.2. The eccentric 5.4 comprises, at the end of its major axis distanced farthest from the centre of rotation of the eccentric 5.4, a rounded notch 5.4.1 adapted to cooperate with the rounded addendum 5.2.1.1 formed on the first end 5.2.1 of the jumper 5.2. Thus, when the fly-back hand 2.2 and the chronograph hand 8.2 are superposed, the rounded addendum 5.2.1.1 formed on the first free end 5.2.1 of the jumper 5.2 is located in said rounded notch 5.4.1 of the eccentric 5.4, such that the play between the hands 2.2 and 8.2 is reduced to a minimum. When the fly-back hand 2.2 is stopped, whilst the chronograph hand 8.2 continues to turn, therefore in general in the event of a relative rotation between the hands 2.2 and 8.2, the rounded addendum 5.2.1.1 formed on the first free end 5.2.1 of the jumper 5.2 leaves the rounded notch 5.4.1 of the eccentric 5.4. In this case the pins 5.3 limit the displacement of the free ends 5.2.1, 5.2.2 of the jumper 5.2 such as to avoid any contact with the eccentric 5.4. In addition, due to the use of an eccentric, the rim of the eccentric 5.4 only maintains contact with the rounded addendum 5.2.1.1 formed on the first free end 5.2.1 of the jumper 5.2 over an angular portion close to the major axis distanced farthest from the centre of rotation of the eccentric 5.4. Thus, this play-cancelling means 5 makes it possible to avoid excessive play between the fly-back hand 2.2 and the chronograph hand 8.2 when these are superposed, whilst reducing the friction between the rim of the eccentric 5.4 and the rounded addendum 5.2.1.1 formed on the first free end 5.2.1 of the jumper 5.2. It is clearly possible that the support 5.1 in disc form is formed directly by the chronograph wheel 8.1. Alternatively, it is possible to replace the eccentric 5.4 by a disc having two teeth cooperating with a substantially circular jumper equipped with a sole tooth, and to provide, in the zone of said disc not occupied by the two teeth, a radius selected such as to avoid any friction between the disc and the sole tooth of the jumper.

The explanations above with regard to the structure and the components of a split-seconds device with epicycloidal train 10 according to embodiments as well as the application thereof in a chronograph mechanism allow to easily understand the operation thereof, in particular with the aid of the series of FIGS. 3*a* to 3*c* and 5*a* to 5*f*. In fact, when the control lever 4 is located in the first position thereof illustrated in FIG. 3*a* in which the lever 4 is prestressed by said retaining spring such as to block the second exit wheel 3.3, the resting zone 4.1.1 of the first free end 4.1 of this lever 4 rests on the heart 9.2 secured to the adjacent wheel 9.1. This can be seen best in FIG. 3*b*, which shows a schematic perspective view from below of the device of FIG. 3*a* and which shows the cooperation between the control lever 4 and the heart 9.2 secured to the adjacent wheel 9.1. Thus, the adjacent wheel 9.1 and the crown 3.3, of which the outer toothing 3.3.1 meshes with the adjacent wheel 9.1, are blocked against any rotation, such that the planet carrier 3.2 and also the split-seconds pinion 2.1 meshing with the planet carrier 3.2 and carrying the fly-back hand 2.2 are released. In this case, when the chronograph wheel 8.1 is coupled with the geartrain of the timepiece and is thus kinematically connected to the power source of the timepiece, it turns the sun wheel 3.1.1 by means of the first, and second intermediate pinions 8.3, 8.4. The sun pinion 3.1.2 secured to the sun wheel 3.1.1 meshes with the planetary wheels 3.4 and thus causes a rotation of the planet carrier 3.2, given that the crown 3.3 is blocked and forces the planetary wheels 3.4 to move along the inner toothing 3.3.2 thereof. The outer toothing 3.2.1 of the planet carrier 3.2 meshes with the split-seconds pinion 2.1 and, given that the numbers of teeth on the participating wheels and pinions and therefore their gear ratios are suitably selected, thus causes a synchronous rotation in the superposed state of the fly-back hand 2.2 and the chronograph hand 8.2, which is driven directly by the chronograph wheel 8.1.

When the user of the timepiece actuates the split-seconds push-piece, this pushes the control lever 4 into the second position thereof in which it blocks the first exit wheel 3.2. In this position, illustrated in FIG. 3*c*, the resting zone 4.2.1 of the second free end 4.2 of the lever 4 rests, against the prestress of the retaining spring, on the outer toothing 3.2.1 of the planet carrier 3.2. The latter as well as the split-seconds pinion 2.1 meshing with the outer toothing 3.2.1 of the planet carrier 3.2 are thus immobilized, such that the fly-back hand 2.2 is stopped, whilst the chronograph hand 8.2 continues to turn, provided that the chronograph wheel 8.1 is still coupled to the geartrain of the timepiece. Given that the actuation of the split-seconds push-piece has simultaneously raised the resting zone 4.1.1 of the first free end 4.2 of the lever 4 from the heart 9.2 secured to the adjacent wheel 9.1, the adjacent wheel 9.1 and the crown 3.3, of which the outer toothing 3.3.1 meshes with the intermediate wheel 6.1, are released. In this case, when the chronograph wheel 8.1 is coupled to the train of the timepiece and is thus kinematically connected to the power source of the timepiece, it turns the sun wheel 3.1.1 and the sun pinion 3.1.2 thereof. The latter drives the planetary wheels 3.4 in rotation, the arbors of which remain stationary, given that the planet carrier 3.2 is immobilized, and thus causes a rotation of the crown 3.3, of which the inner toothing 3.3.2 meshes with the planetary wheels 3.4. The crown 3.3 turns the adjacent wheel 9.1 carrying the heart 9.2 and also the intermediate wheel 6.1 and thus causes a rotation of the difference wheel 7.1. Given that the numbers of teeth on the intermediate wheel 6.1 and the difference wheel 7.1 and therefore their gear ratios are also suitably selected, the difference hand 7.2 mounted on the difference wheel 7.1 rotates synchronously with the chronograph hand 8.2, which is driven directly by the chronograph wheel 8.1. Thus, the difference hand 7.2 allows to display the time difference between the chronograph hand 8.2 and the fly-back hand 2.2 when the latter is stopped.

When the user of the timepiece actuates the split-seconds push-piece again, the control lever 4 returns to its first position in which the resting zone 4.1.1 of the first free end 4.1 of this lever 4 rests on the heart 9.2, by releasing the planet carrier 3.2, respectively by blocking the crown 3.3. Before the blocking of the crown 3.3 is active, the progressive pressing of the lever 4 on the heart 9.2 secured to the adjacent wheel 9.1 causes the heart 9.2 to return to its rest position in which said resting zone 4.1.1 of the first free end 4.1 of the lever 4 is facing the flat part of the heart 9.2, defining the position in which the chronograph hand 8.2 and the fly-back hand 2.2 are superposed. The adjacent wheel 9.1 then rotates through an angular distance that corresponds to the distance between the chronograph hand 8.2 and the fly-back hand 2.2. This drives the crown 3.3, which in turn turns the planet carrier 3.2, given that the sun pinion 3.1.2 is secured in its angular position by the sun wheel 3.1.1 meshing with the chronograph wheel 8.1. The planet carrier 3.2 turns the split-seconds pinion 2.1 such that the fly-back hand 2.2 "flies to" the chronograph hand 8.2 and is again superposed with the chronograph hand 8.2. At the same time the intermediate wheel 6.1, connected to the adjacent wheel 9.1 by means of the outer toothing 3.3.1 of the crown 3.3, turns the difference wheel 7.1 such that the difference hand 7.2 returns to the rest position thereof, indicating a zero difference between the fly-back hand 2.2 and the chronograph hand 8.2. Since the heart 9.2 is substantially symmetrical, the fly-back can take place in both directions of rotation, but is always performed automatically in the direction of rotation in which the fly-back hand 2.2 travels the shortest distance. Once the heart 9.2 as well as the fly-back hand 2.2 and the difference hand 7.2 are in their respective rest positions the split-seconds device 10 is ready for a new actuation.

Figure 5A:
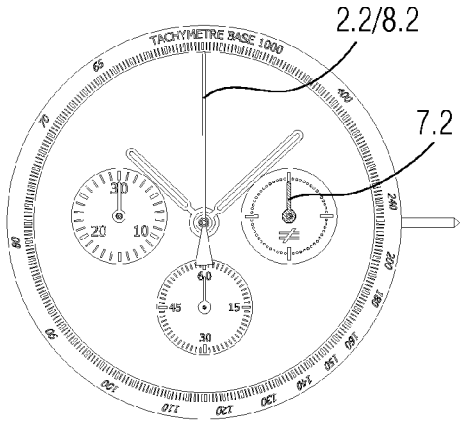
FIGS. 5*a* to 5*f* show, in schematic views from above, different steps of the display as produced during the operation of a timepiece equipped with a chronograph mechanism as well as a split-seconds device with epicycloidal train according to the present invention.
Figure 5B:
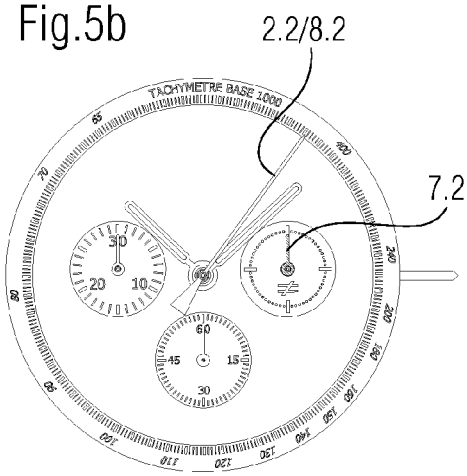
Figure 5C:
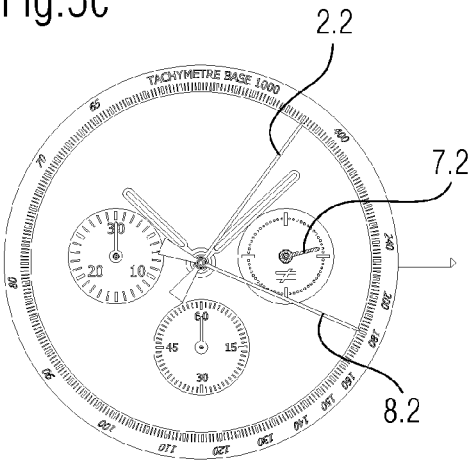
Figure 5D:
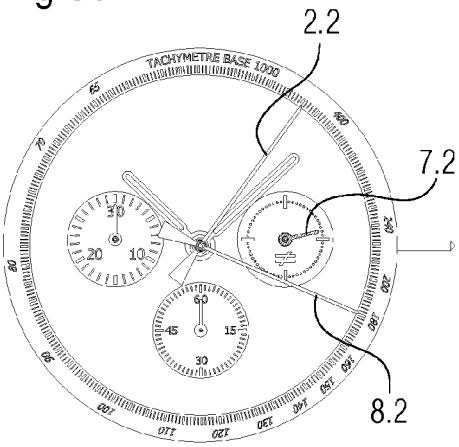
Figure 5E:
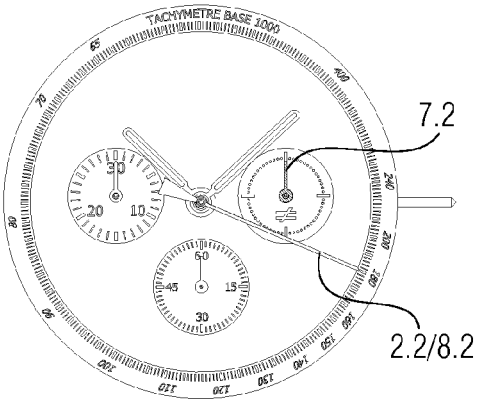
Figure 5F:
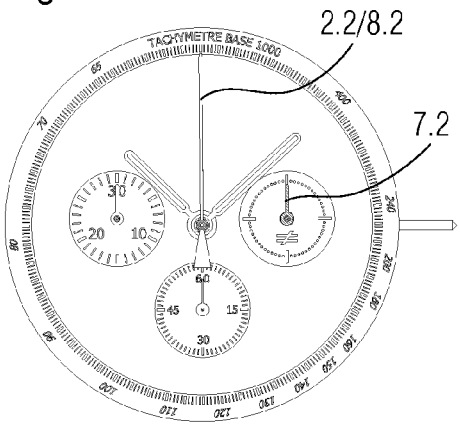

FIGS. 5*a* to 5*f* show, by way of example and in schematic views from above, different steps of the display as produced during the operation of a timepiece equipped with a chronograph mechanism and also a split-seconds device with epicycloidal train 10 according to the present invention. In FIG. 5*a* the chronograph is stopped, the fly-back hand 2.2 being superposed on the chronograph hand 8.2. The difference hand 7.2 displays, of course, a difference between the fly-back hand 2.2 and the chronograph hand 8.2 equal to zero. When the user of the corresponding timepiece starts the chronograph by actuating the start-stop push-piece of the chronograph, the fly-back hand 2.2 remains superposed on the chronograph hand 8.2, and the two hands 2.2, 8.2 move together, the split-seconds pinion 2.1 being released and such as illustrated symbolically in FIG. 5*b*. The difference hand 7.2 still displays a difference of zero. When the user actuates the split-seconds push-piece, he stops the fly-back hand 2.2 by blocking the split-seconds pinion 2.1 by means of the differential 3 and the lever 4, whilst the chronograph hand 8.2 continues to turn. This is illustrated in FIG. 5*c*, like the fact that the difference hand 7.2 now displays the time difference between the fly-back hand 2.2 and the chronograph hand 8.2. When the user of the corresponding timepiece again actuates the start-stop push-piece of the chronograph, he stops the chronograph, such that the chronograph hand 8.2 is also stopped, as shown in FIG. 5*d*. The difference hand 7.2 still displays the time difference between the fly-back hand 2.2 and the chronograph hand 8.2. When the user releases the split-seconds pinion 2.1 by again actuating the split-seconds push-piece, the fly-back hand 2.2 re-joins the chronograph hand 8.2, as described above and illustrated in FIG. 5*e*. The difference hand 7.2 again displays a difference of zero. When the user of the corresponding timepiece finally actuates the zero-reset push-piece of the chronograph, the fly-back hand 2.2 and the chronograph hand 8.2 return together to the rest position, this return to zero being illustrated in FIG. 5*f*. This has no influence on the display produced by the difference hand 7.2. In the scenario described above, the user has released the fly-back hand 2.2, in the step corresponding to FIGS. 5*d* and 5*e*, when the chronograph hand 8.2 was stopped, but it is possible to release the fly-back hand 2.2 even if the chronograph hand 8.2 is moving. Likewise, it is possible to reset the chronograph hand 8.2 to zero without the fly-back hand 2.2. In this context it remains to be noted that once the fly-back hand 2.2 has been started, it can only return to zero if the chronograph hand 8.2 is reset to zero.

Embodiments of the invention also relate to a chronograph mechanism intended to be integrated in a chronograph watch, comprising a chronograph wheel 8.1 carrying a chronograph hand 8.2, said chronograph wheel 8.1 being adapted to be driven by a driving wheel of a geartrain of the movement of the chronograph watch, and a control mechanism or means allowing to start and stop the measurement of a timed period. Such a chronograph mechanism according to the present invention should comprise at least one split-seconds device with epicycloidal train 10 as described above, each fly-back hand 2.2 being mounted to as to rotate freely about the rotation arbor 1 of the corresponding chronograph hand 8.2. In fact, it is possible to equip, for example, only a seconds chronograph hand with a fly-back hand, but it is also possible to equip all the hands of the chronograph with a fly-back hand if said chronograph also has a minutes chronograph hand and an hours chronograph hand. For this purpose, the chronograph mechanism may be equipped with a plurality of split-seconds devices with epicycloidal train 10, each controlling a single fly-back hand, or with a single split-seconds device with epicycloidal train 10, which controls all the fly-back hands by providing a kinematic connection with suitable gear ratio between the corresponding split-seconds pinions.

Lastly, embodiments of the invention also relate to a timepiece, in particular a mechanical wristwatch, which comprises at least one split-seconds device with epicycloidal train 10 or a chronograph mechanism as described above. In particular, the timepiece may be not only a timepiece equipped with a chronograph, but also another type of timepiece, for example, a mechanical wristwatch comprising simply an hours hand, a minutes hand and/or a seconds hand. In this case the timepiece may comprise at least one split-seconds device with epicycloidal train 10 according to an embodiment of the invention, each fly-back hand 2.2 being mounted such as to rotate freely about the rotation arbor 1 of one of the hours, minutes and/or seconds hands of said timepiece. This may allow, for example, to mark the exact hour of the start of an event during the course of the day by means of the fly-back hand 2.2 by pressing for a first time on the split-seconds push-piece, the duration of the event being displayed simultaneously by the difference hand 7.2. At the end of the event, it suffices, by pressing for a second time on the split-seconds push-piece, to return the fly-back hand 2.2 to the position thereof superposed with the corresponding hand in order to return to a normal time display mode.

Given the arrangement and the operation of the device described above, it is understood that a split-seconds device with epicycloidal train according to embodiments makes it possible to drive or to block a fly-back hand, for example, of a chronograph of a mechanical watch, with the aid of a planetary system placed between the power source of the timepiece and the pinion of the fly-back hand. The differential makes it possible to provide, at the same time and in a relatively simple manner, a function similar to that of the lifting-lever of conventional split-seconds mechanisms, limiting the negative effects of the presence of a fly-back hand on the running accuracy of the timepiece equipped with this device. When the device also comprises a difference wheel carrying a difference hand and also an adjacent wheel carrying a heart and/or an intermediate wheel, the device also makes it possible, on the one hand, to press the necessary hammers in this type of mechanism against arbors other than the thin arbors carrying the hands, and, on the other hand, to integrate an additional function in a split-seconds mechanism, i.e., the display of the time difference between the fly-back hand and the corresponding hand, for example, the chronograph hand, when the fly-back hand is stopped. At the same time, the device is provided with a robust structure as well as with a secure and reliable operation. These advantages are obtained whilst ensuring that the split-seconds device with epicycloidal train according to the present invention can be used for a plurality of applications and thus has a certain level of flexibility. In particular, this split-seconds device with epicycloidal train can be integrated advantageously in chronograph watches or simply in watches only equipped with a normal time display. In general, the device can be integrated in any sort of timepiece, preferably in mechanical wristwatches, but it is also possible to use it in electronic watches.

The invention claimed is:

1. A split-seconds device for a timepiece the device comprising:

a split-seconds pinion which carries a fly-back hand and is mounted such as to rotate freely about a rotation arbor of said timepiece;

a differential having an entry wheel adapted to be kinematically connected to a power source of the timepiece;

a first exit wheel kinematically connected to the entry wheel by at least one planetary wheel and meshing with the split-seconds pinion;

a second exit wheel kinematically connected to said entry wheel by said at least one planetary wheel, and a control lever allowing to block either the first exit wheel or the second exit wheel, such that whichever of the first exit wheel and the second exit wheel is released by the control lever is adapted to be driven by said entry wheel when the latter is kinematically connected to the power source of the timepiece, thus allowing to block or respectively release said fly-back hand.

2. The split-seconds device according to claim 1, wherein the control lever allowing to block either the first exit wheel or the second exit wheel is prestressed by a retaining spring in a first position in which the lever blocks the second exit wheel, such that the fly-back hand is released, the lever being adapted to be brought by the user of the timepiece into a second position in which the lever blocks the first exit wheel, such that the fly-back hand is blocked.

3. The split-seconds device according to claim 1, further comprising a difference wheel kinematically connected to the second exit wheel and carrying a difference hand.

4. The split-seconds device according to claim 3, further comprising an intermediate wheel kinematically connected to the second exit wheel and meshing with said difference wheel.

5. The split-seconds device according to claim 4, further comprising an adjacent wheel kinematically connected to the second exit wheel and carrying a heart adapted to cooperate with said lever.

6. The split-seconds device according to claim 3, wherein the outer toothing of said crown forming the second exit wheel meshes with said intermediate wheel which meshes in turn with the difference wheel, thus realizing the kinematic connection between the difference wheel and the second exit wheel.

7. The split-seconds device according to claim 6, wherein the control lever, in the first position thereof in which the lever is prestressed by a retaining spring and blocks the second exit wheel, rests on the heart secured to the adjacent wheel such that the crown is blocked and the split-seconds hand is released, and, in the second position thereof in which the lever blocks the first exit wheel, rests on the outer toothing of the planet carrier such that the planet carrier and the fly-back hand are blocked, simultaneously releasing said difference hand.

8. The split-seconds device according to claim 1, wherein the entry wheel of the differential is formed by a sun wheel secured to a sun pinion, the first exit wheel being formed by a planet carrier mounted such as to rotate freely about the arbor of the differential and carrying at least one planetary wheel meshing with said sun pinion, the second exit wheel being formed by an outer toothing of a crown mounted such as to rotate freely about the arbor of the differential and meshing by means of an inner toothing with said at least one planetary wheel.

9. The split-seconds device according to claim 1, further comprising a play-cancelling mechanism having a support in the form of a disc secured to the chronograph wheel and carrying a jumper of substantially circular shape, as well as an eccentric of substantially elliptical shape and secured to the split-seconds wheel, a first free end of the jumper forming a short arm equipped with a rounded addendum and a second free end of the jumper forming a long arm forming an extended arc of a circle cooperating with pins mounted on said support, the eccentric comprising, at the end of its major axis distanced farthest from the centre of rotation of the eccentric, a rounded notch adapted to cooperate with the rounded addendum formed on the first free end of the jumper.

10. A chronograph mechanism, for integration into a chronograph watch, comprising a chronograph wheel carrying a chronograph hand, said chronograph wheel being adapted to be driven by a driving wheel of a geartrain of the movement of the chronograph watch, and a control mechanism allowing to start and stop the measurement of a timed period, wherein the chronograph mechanism comprises at least one split-seconds device with epicycloidal train according to claim 1, each fly-back hand being mounted such as to rotate freely about the rotation arbor of said chronograph hand.

11. A mechanical wristwatch comprising the chronograph mechanism of claim 10.

12. A mechanical wristwatch, comprising at least one split-seconds device with epicycloidal train according to claim 1.

13. A mechanical wristwatch, comprising an hours hand, a minutes hand, and/or a seconds hand, and at least one split-seconds device with epicycloidal train according to claim 1, each fly-back hand being mounted such as to rotate freely about the rotation arbor of an hours, minutes and/or seconds hand of said timepiece.

* * * * *